US005397260A

United States Patent [19]

Tilbor et al.

[11] Patent Number: 5,397,260

[45] Date of Patent: Mar. 14, 1995

[54] TOY CRASH CENTER PLAY SET

[75] Inventors: Neil Tilbor, Medford; Anthony R. Garr, Voorhees, both of N.J.

[73] Assignee: Tyco Investment Corp., Wilmington, Del.

[21] Appl. No.: 832,521

[22] Filed: Feb. 7, 1992

[51] Int. Cl.[6] ..... A63H 33/00; A63H 17/44; A63H 29/00; A63H 3/52

[52] U.S. Cl. ..... 446/4; 446/423; 446/429; 446/336; 446/478; 482/83; 482/84

[58] Field of Search ..... 446/4, 6, 71, 80, 176, 446/180, 423, 429, 430, 336, 435, 471, 476, 478, 479, 489; 482/83, 84, 85, 87

[56] References Cited

U.S. PATENT DOCUMENTS

| | | | |
|---|---|---|---|
| 676,242 | 6/1901 | Rogers | 482/84 X |
| 694,226 | 2/1902 | Yancey | 482/84 X |
| 1,036,651 | 8/1912 | Lasares | 446/336 X |
| 1,532,482 | 4/1925 | Ford | 446/336 X |
| 2,442,526 | 6/1948 | Wright | 446/4 |
| 3,029,077 | 4/1962 | Benkoe | 446/4 X |
| 3,037,772 | 6/1962 | Bonanno | 446/4 X |
| 3,430,581 | 3/1969 | Truesdell et al. | 446/429 X |
| 3,654,728 | 4/1972 | Beny et al. | 446/423 X |
| 3,757,562 | 9/1973 | Goldberg et al. . | |
| 3,804,406 | 4/1974 | Viscione | 482/83 X |
| 3,866,909 | 2/1975 | DeSantis | 482/83 X |
| 3,936,053 | 2/1976 | Goldfarb et al. | 446/180 X |
| 3,959,920 | 6/1976 | Ieda . | |
| 4,087,935 | 5/1978 | Edmisson et al. . | |
| 4,261,133 | 4/1981 | Hanson et al. . | |
| 4,472,906 | 9/1984 | Cook et al. . | |
| 4,565,366 | 1/1986 | Struss | 482/84 |
| 4,605,230 | 8/1986 | Halford et al. | 446/429 X |
| 4,734,076 | 3/1988 | Goldstein et al. . | |
| 4,767,375 | 8/1988 | Fassman | 446/423 |
| 4,867,723 | 9/1989 | Asbach . | |
| 4,895,542 | 1/1990 | de Blanitza | 446/471 X |
| 4,974,833 | 12/1990 | Hartman et al. | 482/84 X |
| 5,100,327 | 3/1992 | Gladish | 434/305 |

FOREIGN PATENT DOCUMENTS

| | | | |
|---|---|---|---|
| 2108397 | 5/1983 | United Kingdom | 446/430 |
| 1570738 | 6/1990 | U.S.S.R. | 482/84 |

OTHER PUBLICATIONS

"Educational Products Catalog", Health Edco, Waco, Tex., Dec. 1989, Front Cover, Rear Cover & p. 43 (Dec. 1989).

"Crash Kramer Instructions", Health Edco, Dec. 1989, 2 pages.

Larry Deutchman, Division Director, Committee For Safety Belt Awareness, Letter to NHTSA (National Highway Traffic Safety Administration), Aug. 1988, 3 pages.

"Instructions/Anleitungen/Istruzioni" Mattel, Inc., 1986, 2 pages.

"Preschool Safety Belt Program/Ready Click Go", Iowa Dept. of Transportation, Dec. 1989, Cover and pp. 1-12.

Photographs of Iowa Dept of Transportation Toy 3-Dimensional Land Vehicle with 3-Dimensional Human shape Passenger Figures and Velcro® Seat Belts and Ramp, Iowa Dept. of Transportation, Dec. 1989, 5 pages, 17 photographs.

Jolly K. "Children & Traffic/1 On the pavement/A book for teachers", 1977, Cover, copyright page and p. 31.

*Primary Examiner*—Robert A. Hafer

*Assistant Examiner*—D. Neal Muir

*Attorney, Agent, or Firm*—Panitch Schwarze Jacobs & Nadel

[57] ABSTRACT

A toy vehicle crash center play set includes a base mounting three separate upright walls. Two of the walls are interchangeable at the center and lateral side positions along one edge of the base. One interchangeable wall includes a mechanical impact meter with a horizontally movable target and a linkage coupled impact indicator. The second interchangeable wall includes four pivotally mounted wall panels having irregular perimeters which interfit with one another and rotate apart as a "break away" wall. A separate launcher including a base, a hand-operated actuator coupled to the base and a carrier movably driven along the base by the actuator, is provided and releasably engages with depressions provided at various positions in the base. Additional elements which are provided for mounting to the base and/or walls include different toy vehicle components, signposts, mailbox and parking meter and a pair of upright supports. The upright supports, the launcher and targets on the first wall can releasably mount any of the toy vehicle parts.

28 Claims, 7 Drawing Sheets

FIG. 9
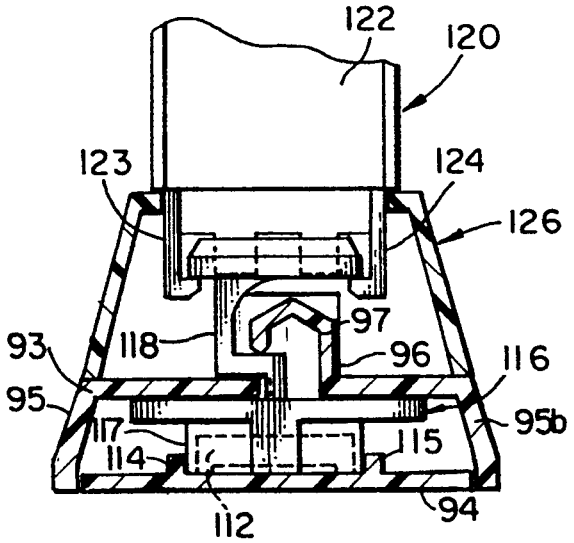
FIG. 10
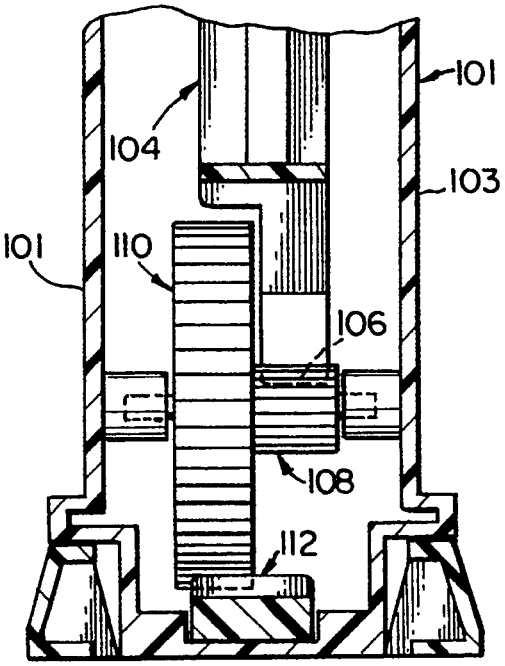
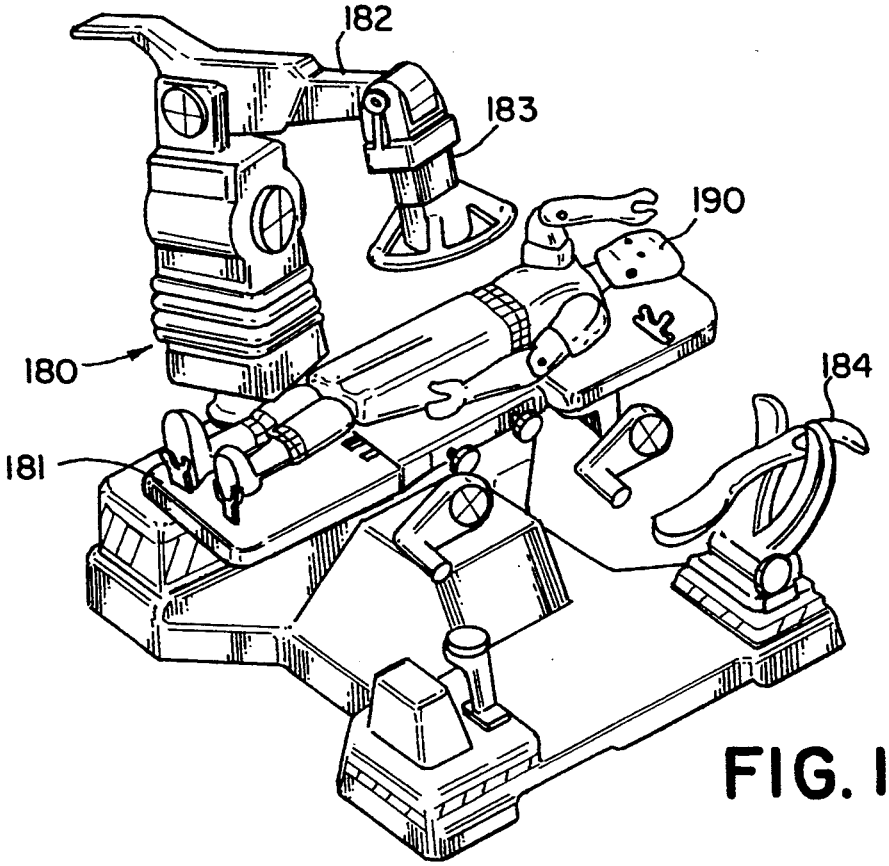
FIG. 13

TOY CRASH CENTER PLAY SET

FIELD OF THE INVENTION

The invention relates to children's toys and, in particular, to play sets configured as interactive building structures.

BACKGROUND OF THE INVENTION

In recent years, toy action figures have gained widespread popularity among children. Also gaining popularity with such figures are play sets in the form of interactive building structures having movable parts designed to set the scene where such figures are typically found and to extend the reality of play.

As part of its mandate to promote highway safety, the Department of Transportation (DOT) has, in recent years, promoted through advertisements and other media, two "living" vehicle crash test dummies: "Vince" and "Larry". Their traffic safety message is often delivered with the depiction of a vehicle crash in a motor vehicle crash test center in which one or both of the dummies is broken apart or otherwise damaged.

SUMMARY OF THE INVENTION

The present invention is directed to a toy vehicle crash center play set which permits a message of vehicle safety to be provided to children through play. In one aspect, the toy vehicle crash center play set of the present invention comprises an at least generally vertical first target, an impact indicator spaced apart from the first target and a linkage mechanically coupling the first target with the impact indicator. The linkage moves the indicator a distance related to movement of the first target when the first target is impacted in an at least generally horizontal direction. The play set further comprises a housing supporting at least the linkage for simultaneous movement of the impact indictor with the first target when the first target is impacted. The impact indicator and the first target are both visible from outside the housing. The play set further comprises means adjoining the impact indicator for indicating with the impact indicator severity of the impact against the first target from location of the indicator with respect to the means.

In another aspect, the invention comprises a toy vehicle crash center play set comprising a base and a first wall extending generally vertically from one side of the base. The play set further comprises a first target at least partially protruding from an outer surface of the first wall generally proximal the base. The first target is supported for movement at least towards the first wall. The play set further comprises an impact indicator supported for movement with respect to the first wall. The play set further comprises a linkage coupling the first target with the impact indicator and moving the impact indicator in response to movement of the first target towards the first wall.

In another aspect, the invention comprises a toy vehicle crash center play set comprising a base; a first wall; and a second wall including a pair of generally vertical planar wall members, each planar wall member being supported from the second wall for pivotal movement together and apart, each of the planar wall members having an irregularly configured perimeter adjoining a complementarily irregular perimeter of the remaining wall member of the pair, the irregular perimeters interfitting when the pair of planar wall members are pivoted together. The base includes at least two separate, spaced apart positions, each position being configured to releasably matingly receive either of the first and second walls whereby each of the first and second walls are releasably mountable to the base at either of the at least two separate spaced apart positions, extending generally vertically from the base.

BRIEF DESCRIPTION OF THE DRAWINGS

The foregoing summary, as well as the following detailed description of preferred embodiments, will be better understood when read in conjunction with the appended drawings. For the purpose of illustrating the invention, there is shown in the drawings embodiments which are presently preferred. It should be understood, however, that the invention is not limited to the specific methods and instrumentalities disclosed. In the drawings:

FIG. 9 is a transverse section along the lines 9—9 of FIG. 8;

FIG. 10 is a transverse section along the lines 10—10 of FIG. 8;

FIG. 13 depicts a chair accessory and figure optionally used with the play set.

DETAILED DESCRIPTION OF PREFERRED EMBODIMENTS

Figure 1:
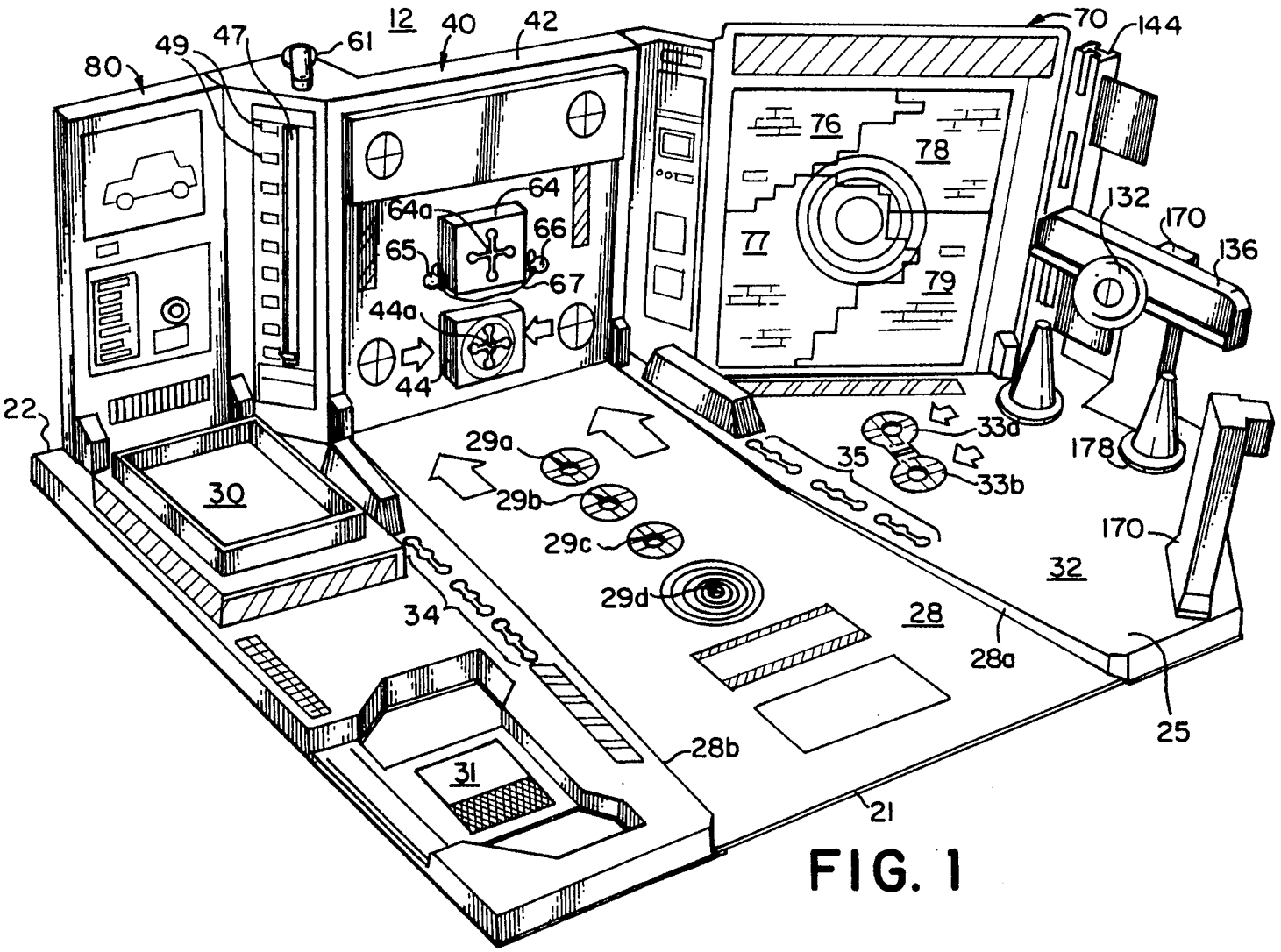
FIG. 1 is a diagrammatic perspective view of the crash center structure of a preferred toy vehicle crash center play set of the present invention.

Certain terminology is used in the following description for convenience only and is not limiting the words "right" "left" "lower" and "upper" designate words in the drawings to which reference is made. The words "inwardly" and "outwardly" refer to directions towards and away from, respectively, the geometric center of the device, designated part or drawing, as will be clear from the context. The terminology includes the words specifically mentioned above, derivatives thereof and words of similar import.

Referring to the drawings, where like numerals are used to indicate like numerals throughout, there is shown in the various figures the preferred components of a toy vehicle crash test play set. A major component of the play set is a housing or building structure in the form of a toy vehicle crash test center, indicated generally at 12. Preferably, the test center 12 is provided by a generally horizontal base of molded plastic, indicated generally at 20, and at least one, and preferably three separate walls 40, 70 and 80, respectively. Several of the individual toy components which can be used with the housing 12 are indicated in stowed positions.

Preferably, the base 20 has opposing "front" and "rear" edges 21, 22 and is configured to receive a lower end of and to support in an upright, generally vertical orientation, each of the three walls 40, 70 and 80 generally near the rear edge 22. Preferably, each wall 40, 70, 80 is snugly received in a left, center or right position portion 23*a*, 23*b* or 23*c*, respectively, of an elongated recess, indicated generally at 23. Recess 23 is suitably configured into an upper surface 25 of the base and releasably secured by a mating fit, preferably with frictional engagement. Preferably, other conventional means are also provided to more securely fix each wall 40, 70, 80 to the base 20. These conventional means might include resilient detents, formed as part of each wall or part of the base which interferingly engage with a complementary mating structure on the remaining one of the walls and the base. More specifically, walls 40, 70 and 80 preferably are secured to the base 20 by a plurality of preferably identical pegs 26 which are passed beneath an upper layer of the plastic preferably forming the upper surface 25 of the base 20 and into closed perimeter recesses 41, 71 and 81, respectively, located proximal the bottom of each wall 40, 70, 80. Pegs 26 actually pass through the open ends of recesses 41, 71 to more securely fix walls 40 and 70 to base 20. This simplifies the construction of the play set and permits the individual walls 40, 70 and 80 to be removed and/or replaced, if desired or if needed due to damage, malfunction, etc. Preferably, the recess 23 is configured to matingly receive either of the first and second walls 40, 70 at either the center position 23*b* or the rightmost position 23*c* so that those walls 40, 70 might be reversed in position on the base 20 to vary the configuration of the housing 12 and multiply the possible play scenarios. A central ramp 28 is provided on upper surface 25 extending from the front edge 21 of the base to the central recess position 23*b*. Ramp 28 is defined by raised, tapering surfaces 28*a*, 28*b*. Ramp 28 is provided with a series of four cylindrical depressions 29*a*–29*d* extending along a center line through the central recess position 23*b*. To the left of ramp 28 a raised tray 30 is provided to receive loose accessories (not depicted) such as automobile repair tools, while a depression 31 is provided to receive one end of an accessory device 180, shown in FIG. 13, and which includes an adjustable chair 181, an upwardly biased, pivotally mounted lever arm 182 with removable action figure, actuator head 183 and a separate biased gripping claw 184 mountable to lever arm 182 in place of head 183. Head 183 is designed to actuate one or more buttons on the torso of action FIG. 190. Left and right portions of chair 181 pivot with respect to the center portion and can be separated from the center portion by use of the indicated crank handles.

Preferably, first wall 40 is a multi-piece assembly that includes an impact meter. Referring to FIGS. 3 through 7, the wall 40 preferably includes a hollow outer housing primarily formed by two interfitting front and rear shells 42 and 43 and a backing plate 55 received in a central opening through the rear shell 43. The impact meter preferably is provided by an at least generally vertical first target 44, an impact indicator 46 and a linkage 50 located between shells 42, 43. First target 44 is located in a passageway 45 provided in and through the front shell 42. Impact indicator 46 is positioned in a vertical slot 47 also extending through the front shell 42. The first target 44 and impact indicator 46 are thus both exposed and visible on a front side 48 of the wall 40. A series of gradations 49 are preferably embossed on the front side 48 of the first wall 40 adjoining slot 47 as a stationary scale, which, with impact indicator 46, indicates degree or severity of an impact against the first target 44. Other means can be provided on the first wall 40 to indicate with the impact indicator 46 severity of impacts against the first target 44. Even the height of the close-ended slot 47 provides a scale with respect to which movement of the indicator 46 can be judged and severity of an impact displayed, indicated, estimated and/or determined. Scale gradations can be provided by other known, conventional means besides embossing the plastic surface of the front shelf 42, including, for example, painting, the attachment of decals or individual markers. The linkage, indicated generally at 50, mechanically couples the first target 44 with the impact indicator 46. The linkage 50 is supported by the housing components 42, 43, 55 of the wall 40 and moves the indicator 46 when the first target 44 is impacted in an at least generally horizontal direction which forces the protruding portion of the first target 44 back towards front side 48 and into the wall 40. The linkage 50 moves the indicator 46 a distance vertically which is related to the severity of the horizontal impact against the first target 44.

The linkage 50 is provided by a compression coil spring 51 extending rearwardly from the first target 44 to a first arm 52 pivotally supported on an axle 53. A second arm 54 is integrally joined with the axle 53 and first arm 52 and rises with inward movement of the first target 44. The backing plate 55 is spaced from and coupled to a rear side of the front shell 42. Backing plate 55 retains axle 53 in position and supports yet a third arm 56 for rotation about a horizontal axis 68 perpendicular to the axle 53. Third arm 56 extends over second arm 54 and includes a distal end 56*a* which extends under the impact indicator 46. Wire spring 69, indicated in phantom, biases arm 56 downwardly and through arms 54, 52 and spring 51, first target 44 outwardly from the wall. A suitably configured inner end of first target 44 retains the target 44 in the wall. A generally horizontal impact against target 44 forces the target 44 deeper into the passageway 45. This movement is transmitted through spring 51 to first arm 52. Arm 52 rotates axle 53, raising second arm 54. Upward rotation of second arm 54 cams the third arm upwards, lifting the impact indicator 46. If desired, spring 51 can be eliminated and the first target 44 and first arm 52 designed to contact one another directly.

In addition to extending through slot 47, the impact indicator 46 is configured so as to be constrained to run along a narrow passageway 57 defined by inner faces of the front and rear shells 42, 43 proximal the slot 47. The inner side of the back shell 43 forming part of the passageway 57 is provided with a row of serrations or teeth 58 which will engage with a leg 46*a* formed at the bottom of impact indicator 46. The teeth 58 prevent the impact indicator 46 from dropping after it has been raised by the distal end 56*a* of the third arm 56. In this way, the indicator 46 is held in a raised position following an impact against the first target 44.

The impact indicator 46 is reset to the bottom of slot 47 with an elongated reset member 60. Member 60 preferably includes a handle 61 protruding from the top of wall 40, a shaft 62 integral with the handle and a flap portion 63 integral with the shaft and extending transversely from the shaft 62. Handle 61, which extends out from between the shells 42, 43 on the top of the wall 40, permits manual rotation of the member 60 to reset the impact indicator 46. Shaft 62 is supported vertically between the shells 42, 43 in a manner to permit it to pivot so that flap portion 63 strikes and pivots the indicator 46, and pushes indicator leg 46*a* from engagement with the serrations 58, thereby permitting the indicator 46 to again drop to the bottom of the slot 47. Preferably, flap portion 63, indicator 46 and front shell 42 are all made of resilient plastic such that the indicator 46 and/or flap portion 63 biases the reset member 60 back to an initial position when handle 61 is released.

First wall 40 further preferably includes a second target 64 integrally molded in the front side 48 of front shell 42 and located slightly above the first target 44 generally in the horizontal center of the front side of the wall. The second target 64 is provided to receive impacts against the first wall 40 when use of the impact meter is not desired. The second target 64 is preferably provided with a pair of opposing arms 65, 66 extending generally horizontally away from one another and the second target 64. Arms 65 and 66 are preferably provided to pass through slots at ends of a toy belt 67, which can be used to strap a toy figure to the front of target 64 or both targets 44, 64.

Figure 2:
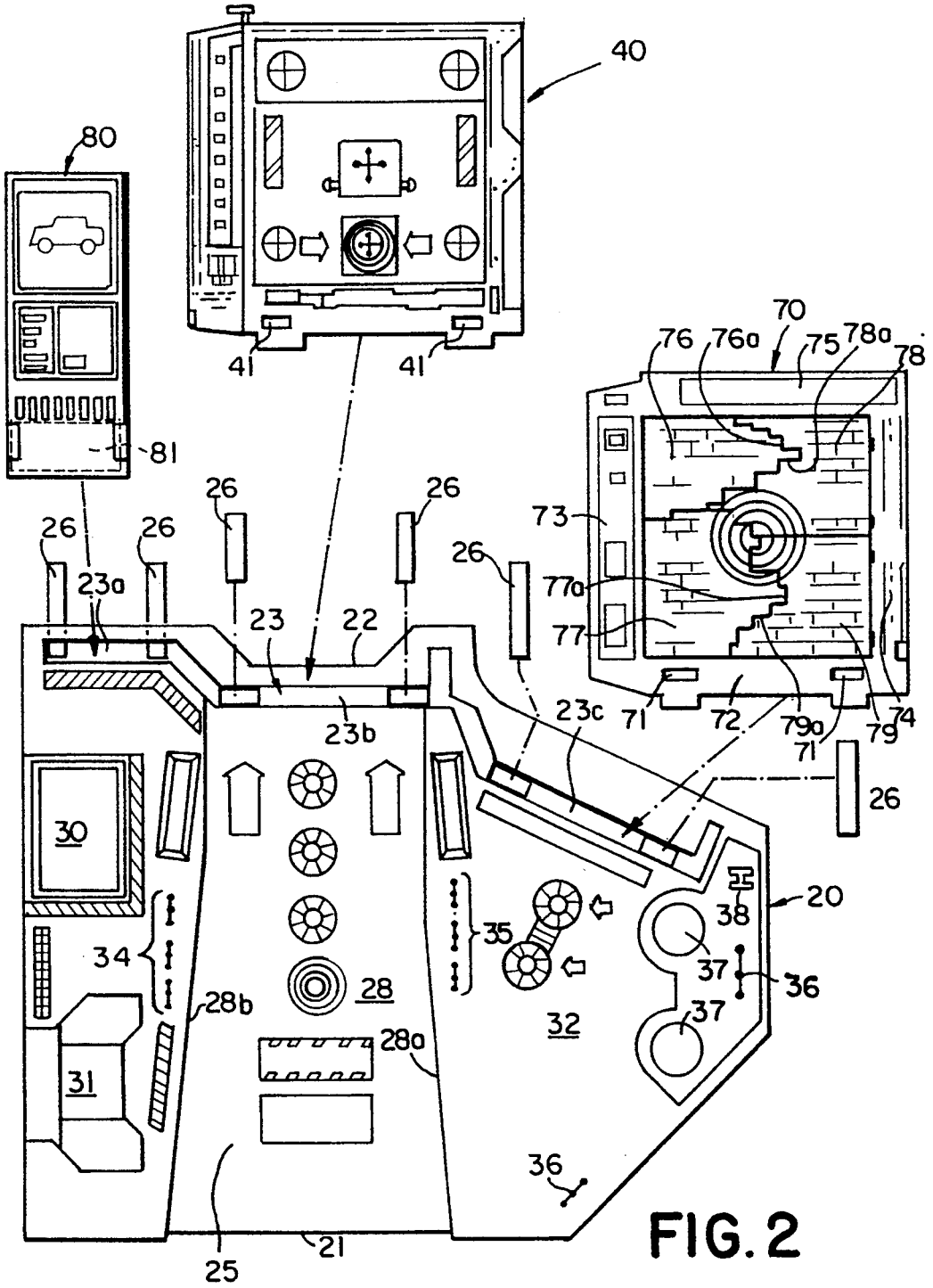
FIG. 2 is a simplified diagrammatic exploded view of the wall and base components of the crash center structure of FIG. 1.
Figure 3:
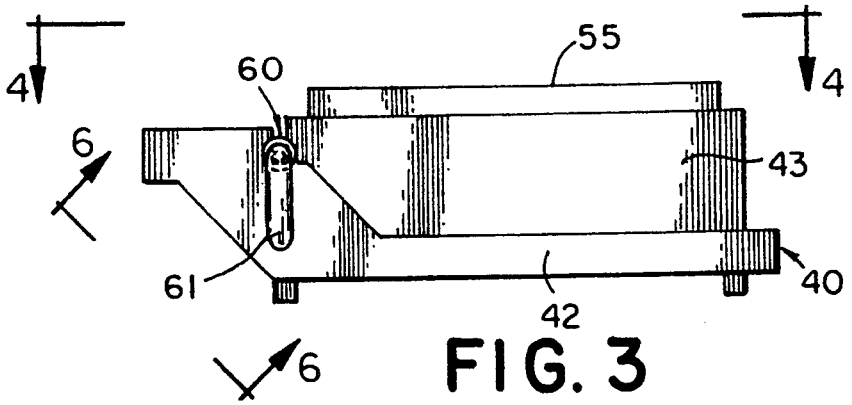
FIG. 3 is a top plan view of a first wall of the play set.
Figure 6:
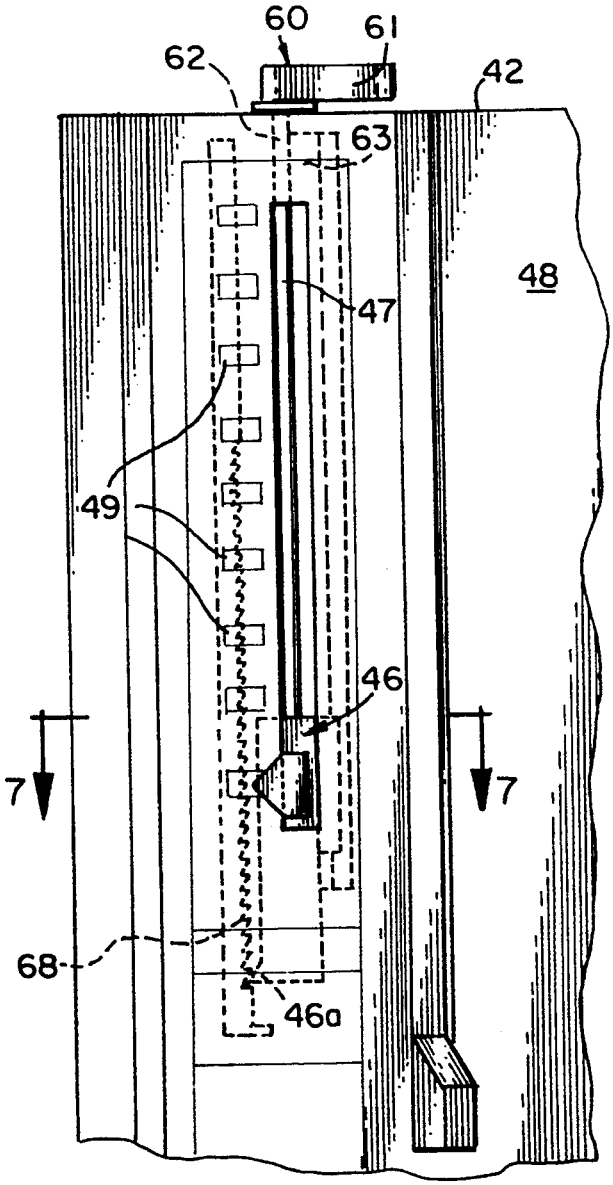
FIG. 6 is a local elevation of the first wall taken along lines 6—6 of FIG. 3.
Figure 7:
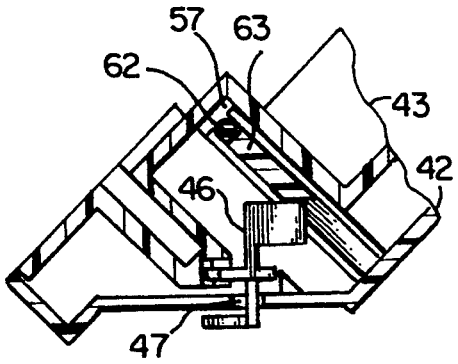
FIG. 7 is a local plan section taken along lines 7—7 of FIG. 6.
Figure 4:
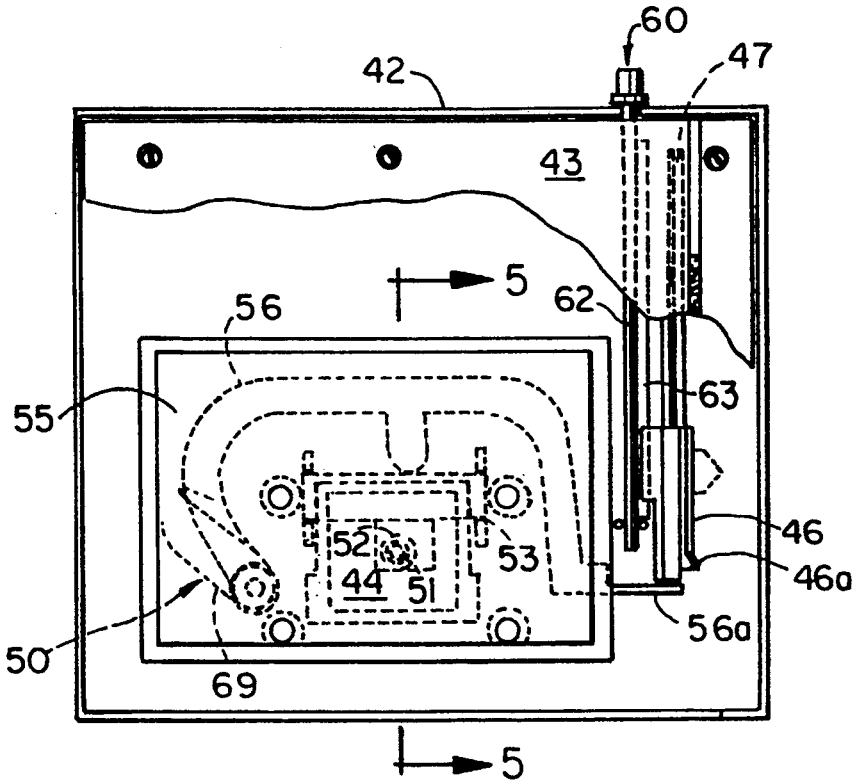
FIG. 4 is a partially broken away rear elevational view of the first wall taken along lines 4—4 of FIG. 3.
Figure 5:
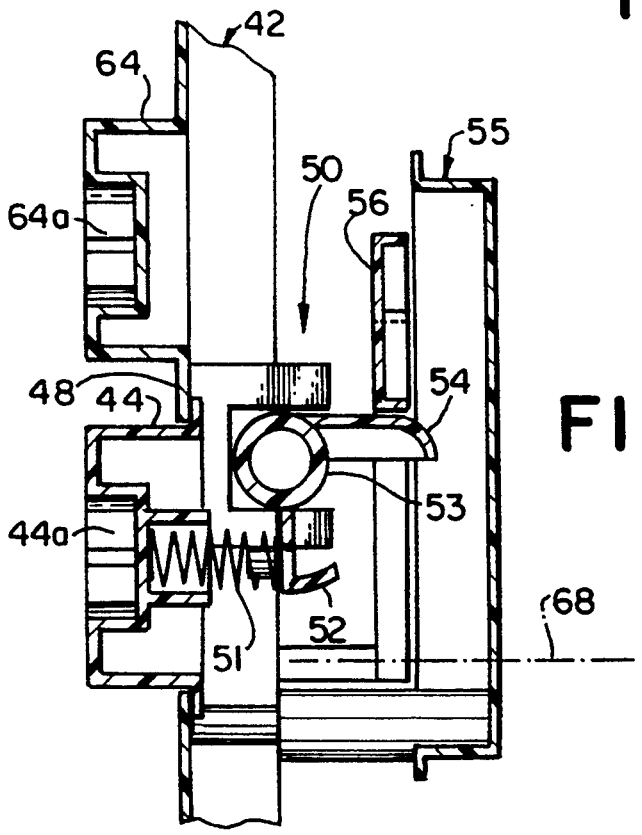
FIG. 5 is a local cross-sectional elevation taken along lines 5—5 of FIG. 4.

Referring to FIG. 2, the second wall 70 is preferably also an assembly including a stationary, hollow frame defined by base 72, first and second side 73, 74 and cap 75 portions, respectively. The portions 72–75 surround and define a central opening 70*a* extending transversely through the second wall 70 and seen in part in FIG. 12. Base portion 72 of the second wall 70 is sufficiently short so as to be substantially flush with the upper surface 25 of base 20 when received at either recess position 23*b* or 23*c*. Preferably, the side portions 73, 74 act as a pair of generally vertical, horizontally spaced apart supports for generally planar wall panel members 76–79. Panels 76 and 77 are pivotally supported on side portion 73 while panels 78, 79 are pivotally supported on side portion 74. Each panel 76–79 preferably has an irregularly configured perimeter 76*a*–79*a*, respectively, which is distal from its support on side portions 73 or 74 and proximal the irregular perimeter of the opposing member of each horizontal pair of panels. Each of the panels 76–79 is positionable within the central opening essentially covering the central opening as shown in FIGS. 1 and 2, and is pivotable to a position generally behind the wall portions 72–75, extending away from the play set base 20 to define the opening 70*a* for a toy vehicle or other object to pass transversely through the wall 70. Preferably, the perimeters 76*a*/78*a* and 77*a*/79*a* of adjoining horizontal pairs of the panels are complementarily irregular so that adjoining horizontal pairs of the panels 76/78 and 77/79 extend essentially entirely across the central opening defined between the side portions 73 and 74. The perimeters between the adjoining upper pair of panels 76 and 78 further preferably complement those of the adjoining lower pair of panels 77 and 79 whereby the panels 76–79 can be positioned to essentially cover or fill the central opening.

It is currently preferred that the third wall 80 not be provided with any movable/removable components, but merely form part of a continuous vertical end of the play set housing 12, with the first and second wall assemblies 40 and 70, respectively, at least near the rear edge 22 of the base 20.

Figure 8:
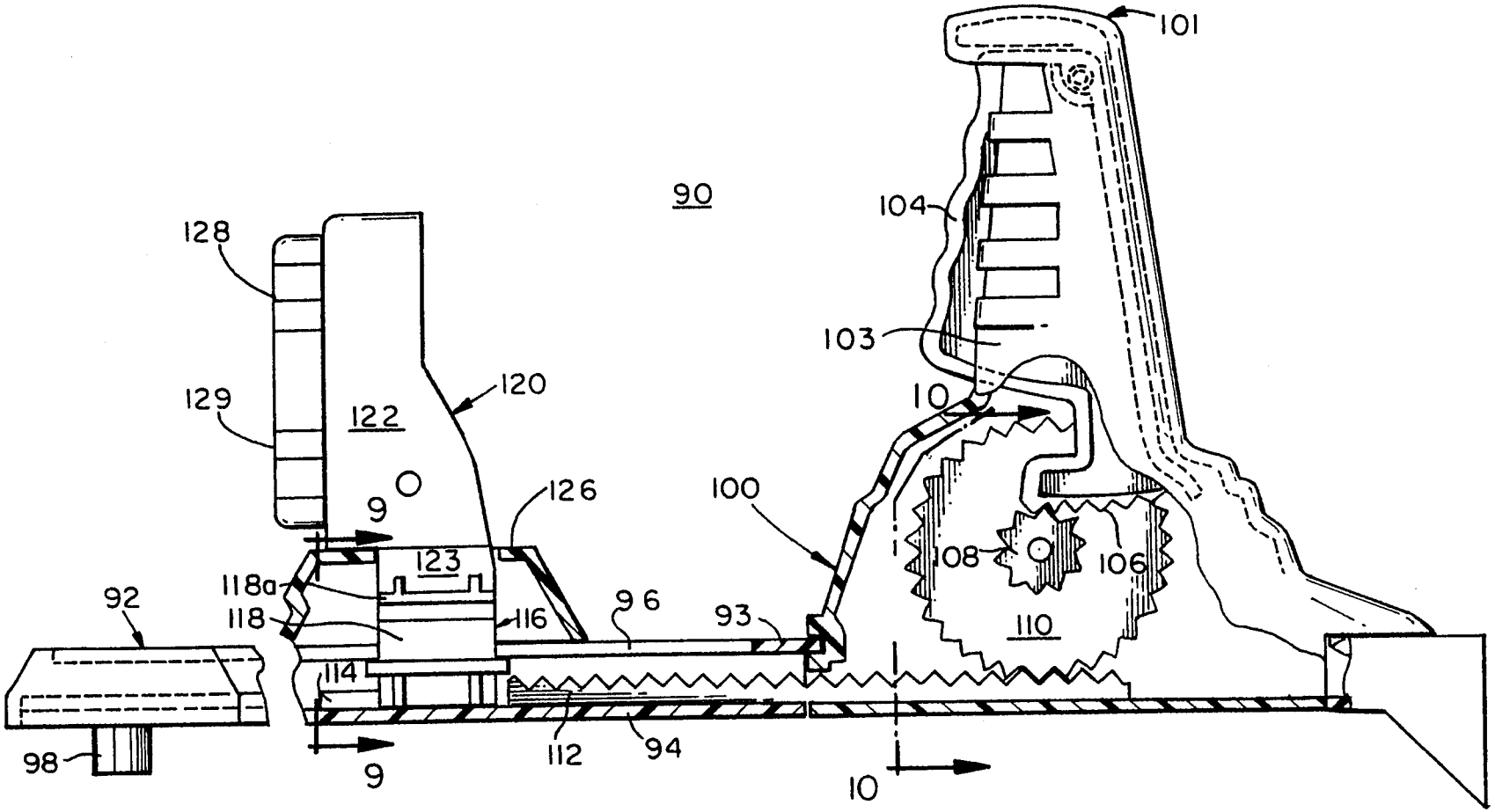
FIG. 8 is a partially broken away, diagrammatic elevation of a launcher of the play set.

Turning now to FIGS. 8 through 10, there is shown, in various views, a preferred launcher, indicated generally at 90, which is used with the toy building structure 12. Preferably, launcher 90 is an assembly which includes a base 92, a sled, which is indicated generally at 120 and is mounted for linear movement along the base 92, and a hand-operated actuator, indicated generally at 100, which is fixedly mounted to the base 92 for propelling the sled 120 along the base 92. Referring to FIGS. 9 and 10, base 92 is preferably provided by vertically spaced horizontal planar upper and lower walls 93, 94, respectively connected by mirror side walls 95*a*, 95*b* all of the same, uniform thickness. Referring to FIG. 8, the actuator 100 preferably includes a handle 101, which is fixedly received in apertures provided through the upper and lower walls 93, 94 of the base 92, and a free-moving rack 112. Handle 101 includes two hand grip portions 102, 103 which are mated together around a lever 104, which is pivotally supported within the grips 102, 103. One lateral side of the lever 104 protrudes from a front side of the handle 101 permitting the lever 104 to be pivoted into the grips 102, 103 to propel the sled 120 along the base 92. A lower end of the lever 104 is provided with a convex arc of downwardly extending teeth 106. Teeth 106 engage teeth of a small diameter pinion 108. Pinion 108 is fixedly, coaxially coupled to a large diameter pinion 110. Both pinions 108, 110 are rotatably supported in the handle 101. The free-moving, toothed rack 112 is provided in the bottom of the base 92 where it is laterally constrained by a pair of flanges 114, 115 extending upwardly from lower horizontal wall 94 of base 92. Flanges 114, 115 limit the rack 112 to linear horizontal movement within the base 92. Longitudinal end openings through the bottom of handle 101 permit the rack 112 to freely pass into and out of the lower end of the handle 101 where it will engage with the teeth of larger pinion 110, while the lower lateral side walls of handle 101 constrain the rack 112 to run beneath pinion 110 and between flanges 114, 115 of the base 92. The actuator 100 formed by handle 101 and rack 112 is used to move and, more particularly, to forcefully drive a separate carrier 116 linearly along a central slot 96 provided vertically through upper wall 93 of the base 92.

Referring to FIG. 9, carrier 116 includes a body portion 117 having sufficient width, thickness and height so as to be trapped between the upper and lower horizontal walls 93 and 94 of the base 92, between flanges 114 and 115 and to be abutted by the proximal end of rack 112 and driven along slot 96 by the rack 112 when the rack 112 is itself being driven by lever 104 and pinions 108 and 110. An upper portion 118 of carrier 116 extends upwardly through the central vertical slot 96 and around a generally inverted J-shaped protrusion 97 extending upwardly from the upper wall 93 on one side of slot 96.

The sled 120 is preferably provided by main member 122 having a pair of detent-carrying legs 123, 124 which extend downwardly and engage flanges on the upper portion 118 of the carrier 116 exposed above protrusion 97. The main member 122 is supported by a hollow skirt 126 having front and rear generally rectangular openings in which the J-shaped protrusion 97 is received. Skirt 126 raises the main member 122, keeping the detents of legs 123, 124 at least generally in contact and engagement with the flanges of the upper portion 118.

A pair of generally cruciform-shaped female mating structures 128 and 129 are provided, one above the other, on a forward facing side of the main sled member 122. The female mating structures 128 and 129 are substantially identical in shape to female cruciform mating structures 44*a* and 64*a* provided in the first and second targets 44 and 64, respectively.

A cylindrical pin 98 is provided extending downwardly from the lower horizontal wall 94 of base 92 at the forward end of the launcher 90. Pin 98 is sized so as to be matingly received in any of four cylindrical depressions 29*a*–29*d* provided along a central ramp 28 of the base 20 fronting first wall assembly 40 in position 23*b* or in either of the two cylindrical depressions 33*a*, 33*b*, provided in a raised platform position 32 of the base 20 fronting the second wall assembly 70. Cylindrical pin 98 and each of the cylindrical depressions 29*a*–29*d*, 33*a* and 33*b* permit the releasable engagement or coupling of the launcher 90 with the base 20 of housing 12, thereby releasably coupling launcher 90 through the base 20 with the impact mechanism of the first wall assembly 40 and the break-away wall formed by the pivotable panel portions 76–79 of the second wall assembly 70.

Figure 11:
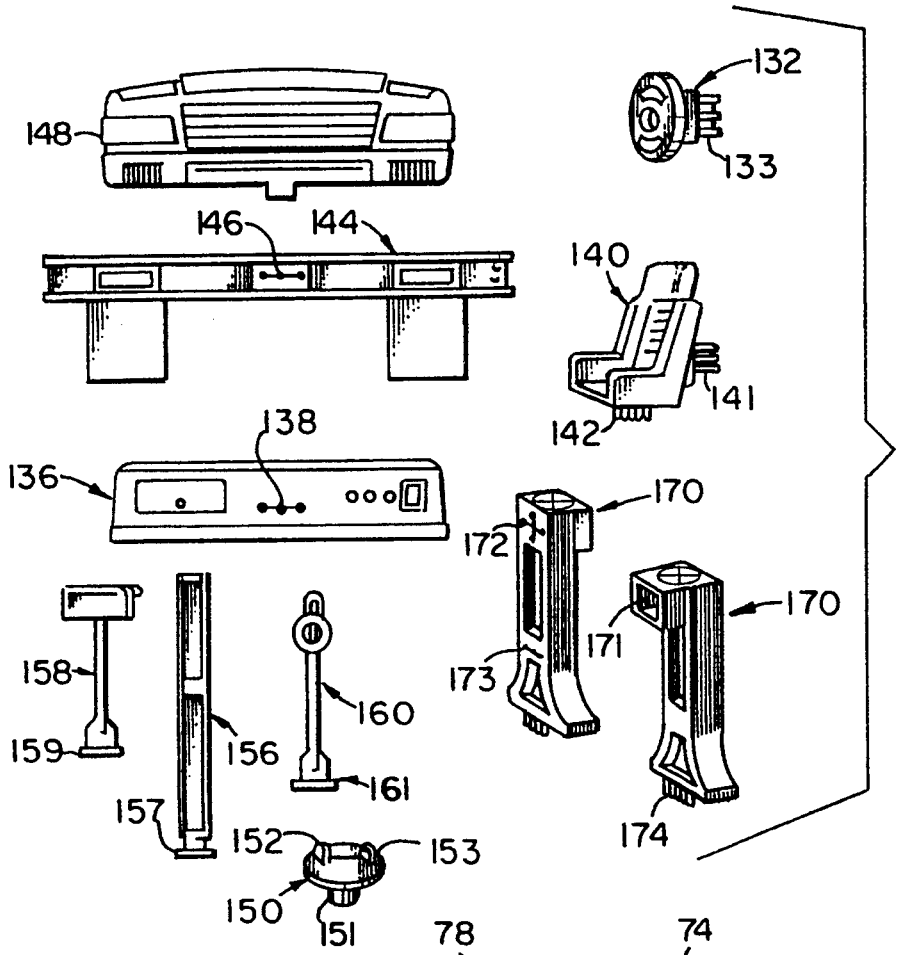
FIG. 11 is a plan elevation of various other individual components which are provided and configured to be releasably mounted in the base, walls or launcher of the play set.

Referring now to FIG. 11, there is preferably provided with the play set a plurality of individual, plug-in accessories. These include a number of toy vehicle components, namely a vehicle steering wheel 132, a vehicle dashboard 136, a vehicle seat 140, a truck bumper 144 and a car body front end 148. Each of the components 132, 136, 140, 144 and 148 includes a generally linear male mating member projecting outwardly from a "rear" side of the component. These male structures complement the female structures 128 and 129 of the sled 120 and 44*a*, 63*a* of the first and second targets, permitting either the sled or either target to releasably receive and support any of the vehicle components 132, 136, 140, 144, 148 in upright or ninety degree rotated positions. Male mating structures 133 and 141 are visible in the figure. Each of the three remaining toy vehicle parts 136, 144 and 148 include an identical structure projecting from the rear, hidden side of the part. In addition, each of the vehicle dashboard 146 and bumper 144 is further preferably provided in its front side with a complementary linear female mating structure 138, 146, respectively, permitting it to receive any of the male mating structures. Seat 140 is further preferably provided with a downwardly projecting linear male mating structure 142.

The play set further preferably includes a post base 150 having a cylindrical pin 151 extending downwardly from a lower side thereof. Preferably, the post base 150 is molded from a resilient plastic material and includes a pair of upward-projecting resilient journals 152, 153. The journals 152, 153 are spaced apart from one another. The journals 152, 153 releasably receive a generally horizontal axle portion 157, 159 and 161, respectively, provided at the bottom of a post portion of a signpost 156, a mail box 158 and a parking meter 160, which are also preferably provided as part of the play set.

Figure 12:
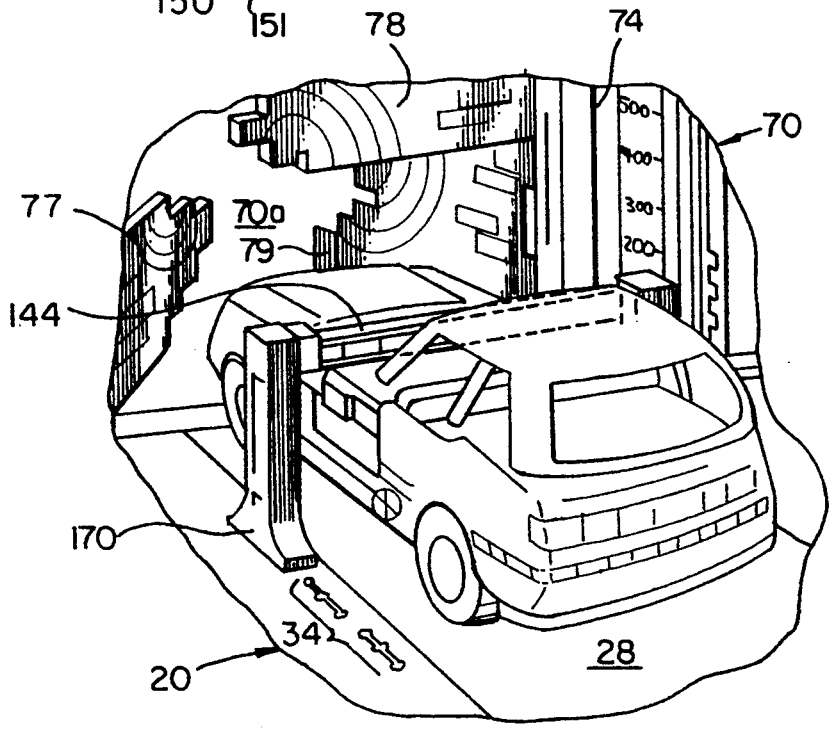
FIG. 12 is a simplified diagrammatic view of the play set of FIG. 1 illustrating an alternate configuration.

Also preferably provided as part of the play set are a pair of identical support members 170. Each support member 170 preferably includes a generally square recess 171 on one lateral side at an upper end of the member, which is sized to receive a longitudinal end of the truck bumper 144. A cruciform-shaped female mating structure 172 is provided at the upper end of support member 170 on a side opposite the square channel 171, while a linear female mating structure 173 is provided beneath the upper mating structure 172. A linear male mating structure 174 projects downwardly from the bottom of the support member 170 and can be received in any of six linear, recessed, female mating depressions, which are preferably molded into the base 20 in sets of three, indicated generally at 34 and 35, on opposite sides of the central ramp 28. The mating structures of each set 34, 35 are spaced from one another to receive one of the support member 170 at different distances along ramp 28, while the support members 170 in return receive and support the truck bumper 144 over the ramp 28, as is illustrated diagrammatically in FIG. 12. When supported in this fashion, the truck bumper 144 can be used to shear the roof from an appropriately designed toy vehicle passed under the bumper 144 as shown in FIG. 12, or to knock a toy figure from an appropriately designed motorcycle, bicycle or other ridden vehicle also passed under the bumper 144. Various other linear female mating structures 36 are provided at various locations in the raised platform portion 32 of the base 20 to preferably receive and support each of the supports 170 and various post accessories 156, 158, 160 when not in use. Circular recesses 37 are preferably provided to receive a pair of traffic cones 178 while an "H"-shaped recess 38 is provided to receive a longitudinal end of bumper 144.

Also, preferably provided for use with the play set are one or more poseable plastic figures. Preferably, these include figures disclosed in a related U.S. patent application entitled "CRASH DUMMY FIGURES" being filed contemporaneously with this application and incorporated by reference herein.

FIG. 12 further depicts the repositioning of the second wall assembly 70 in the center position 23*b* of the recess 23 whereby ramp 28 of the base 20 is aligned with that wall 70 and its wall panel members 76–79 are located at the rear end of ramp 28, extending transversely across that end of the ramp.

While it preferred to have a separate wall assembly 40 which fully incorporates the impact meter, the impact meter could also have been constructed as part of the base or constructed as part of a generally unified wall and base housing. While the launcher 90 is preferably a separate device, it could have been nonreleasably incorporated into the base 20. Moreover, other types of launcher configurations including a hand-operated actuator and a carrier with the actuator for linear movement utilizing the actuator, including other linkages, springs, elastic members, etc. as the propulsive device, can be substituted for the preferred launcher. Although three walls are disclosed, the first and second walls 40 and 70 are of primary interest. Thus, the invention is intended to cover a base with either wall as well as a base mounting both types of walls either in fixed or interchangeable positions.

Preferred embodiments of the present invention have been described and some modifications thereto suggested, it will be recognized by those skilled in the art that other changes could be made to the above-described embodiments without departing from the broad, inventive concepts thereof. It should be understood, therefore, that this invention is not limited to the particular embodiments disclosed, but is intended to cover any modifications which are within the scope and spirit of the invention as defined by the appended claims.

We claim:

1. A toy vehicle crash center play set comprising:

an at least generally vertical first target;

the first target configured to receive a toy vehicle part, the vehicle part having a mounting engagable with the first target, the vehicle part being selected from the group consisting essentially of a vehicle seat, a vehicle steering wheel, a vehicle dashboard, a vehicle bumper and a vehicle body end;

an impact indicator spaced apart from the first target;

a linkage mechanically coupling the first target with the impact indicator, the linkage moving the indicator a distance related to movement of the first target when the first target is impacted in an at least generally horizontal direction;

a housing supporting at least the linkage for simultaneous movement of the impact indicator with the first target when the first target is impacted, the impact indicator and the first target both being visible from outside the housing, the first vertically oriented target being supported from at least one of the housing and the linkage for horizontal movement, the impact indicator being supported from one of the housing and linkage for other than horizontal movement and the linkage converting horizontal movement of the first target to the other than horizontal movement of the impact indicator; and means adjoining the impact indicator for indicating with the impact indicator severity of an impact against the first target from location of the impact indicator with respect to the means.

2. The toy play set of claim 1 further comprising a second target stationarily supported by the housing above the first target and configured to releasably support the at least one toy vehicle part.

3. The toy play set of claim 1 further comprising:

a launcher including a carrier and a hand-operated actuator configured to move the carrier in a linear direction along the launcher, the carrier being configured for releasably receiving the at least one part.

4. The toy play set of claim 3 further comprising a mating structure on the launcher and a complementary mating structure on the housing configured to releasably receive the launcher mating structure with the linear direction pointing towards the first target.

5. The toy play set of claim 4 wherein the at least one vehicle part includes a mating structure and at least one complementary mating structure on the carrier and at least one complementary mating structure on the first target, each of the complementary mating structures on the carrier and first target being configured to releasably engage with the mating structure of the at least one toy vehicle part.

6. The toy play set of claim 4 wherein the toy vehicle part includes a mating structure and further comprising at least two, substantially identical, complementary mating structures spaced apart, one above the other, on the carrier, each complementary mating structure being configured to releasably engage with the mating structure of the at least one toy vehicle part.

7. The toy play set of claim 1 wherein the housing comprises a base including a ramp lying between the first wall and a side edge of the base across the base from the first wall, the ramp being at least generally aligned laterally with the first target.

8. A toy vehicle crash center play set comprising:

an at least generally vertical first target;

an impact indicator spaced apart from the first target;

a linkage mechanically coupling the first target with the impact indicator, the linkage moving the indicator a distance related to movement of the first target when the first target is impacted in an at least generally horizontal direction;

a housing supporting at least the linkage for simultaneous movement of the impact indicator with the first target when the first target is impacted, the impact indicator and the first target both being visible from outside the housing;

means adjoining the impact indicator for indicating with the impact indicator severity of an impact against the first target from location of the impact indicator with respect to the means; and a pair of wall panel members supported from the housing for generally horizontal pivotal movement, one wall panel member of the pair having an irregular perimeter generally proximal to an irregular perimeter of a remaining panel of the pair and configured to interfit with the irregular perimeter of the remaining wall panel of the pair to define at least part of a break apart wall.

9. The toy play set of claim 8 wherein the housing comprises a base including a ramp lying between the pair of wall panel members and a side edge of the base across the base from the pair of wall panel members, the ramp being at least generally aligned with the pair of wall panel members.

10. A toy vehicle crash center play set comprising:

a base;

a first wall extending generally vertically from one side of the base;

a first target at least partially protruding from an outer surface of the first wall generally proximal the base, the first target being supported for movement at least towards the first wall;

an impact indicator supported from the first wall for movement with respect to the first wall; and a linkage coupling the first target with the impact indicator and moving the impact indicator in response to movement of the first target member towards the first wall, the first target, the impact indicator, and the linkage being collectively supported by the first wall and the first wall with first target, impact indicator and linkage being releasably secured with said base.

11. The toy play set of claim 10 wherein the base includes a ramp aligned at least generally with the first target.

12. The toy play set of claim 10 further comprising a separate, toy vehicle component configured to releasably mate with the first target and to be supported on a side of the first target facing away from the first wall.

13. The toy play set of claim 10 further comprising a second target protruding from the outer surface of the wall stationarily positioned above the first target and configured to releasably mate with the at least one toy vehicle part.

14. The toy play set of claim 10 further comprising a launcher coupled with the base, the launcher including a carrier and a hand-operated actuator coupled with the carrier to propel the carrier towards the first target upon hand actuation.

15. The toy play set of claim 14 further comprising at least one toy vehicle part releasably coupled with one of the carrier and the first target facing a remaining one of the carrier and the first target, the part being selected from the group consisting essentially of a toy figure seat, a steering wheel, a dashboard, a vehicle bumper and a vehicle body end.

16. The toy play set of claim 14 wherein the launcher is a separate device releasably coupled with the base, the launcher device including a frame movably mounting the carrier and the hand-operated actuator, the frame further including a mating structure on one side thereof, and the base including a complementary mating structure configured to releasably receive and releasably retain the mating structure of the launcher device.

17. The toy play set of claim 16 further comprising a pair of planar wall members, each planar wall member being supported for pivotal movement together and apart, each of the planar wall members having an irregularly configured perimeter adjoining a complementary irregular perimeter of a remaining wall member of the pair, the irregular perimeters interfitting together.

18. A toy action play set comprising:

a base;

a first wall;

a second wall including a pair of generally vertical planar wall members, each planar wall member being supported from the second wall for pivotal movement together and apart, each of the planar wall members having an irregularly configured perimeter adjoining a complementary, irregular perimeter of the remaining wall member of the pair, the irregular perimeters interfitting when the pair of planar wall members are pivoted together; and the base including at least two separate, spaced apart positions, each position being configured to releasably matingly receive either of the first and second walls, whereby the first and second walls are releasably mountable to the base at either of the at least two spaced apart positions extending generally vertically from the base.

19. The toy play set of claim 18 further comprising a ramp on the base generally aligned laterally with the first wall, the first wall including an impact meter with a target generally aligned laterally with respect to the ramp.

20. The toy play set of claim 18 further comprising a ramp on the base generally aligned laterally with the second wall and the pair of planar wall members.

21. The toy play center of claim 18 further comprising a launcher including a carrier and a hand-operated actuator mounted to move the carrier in a linear direction along the launcher.

22. The toy play set of claim 18 further comprising a launcher including a carrier, a hand-operated actuator coupled with the carrier so as to move the carrier and a mating structure, and further comprising a complementary mating structure on the base configured to releasably receive the launcher mating structure.

23. The toy play set of claim 22 further comprising at least a second complementary mating structure on the base configured to releasably receive the launcher mating structure, the complementary mating structure and the second complementary mating structure being at spaced apart positions on the base enabling the mating structure to be removably mated to the base at either of the at least two spaced apart positions.

24. The toy play set of 23 wherein the mating structure and each complementary mating structure pivotally engage when mated together to pivotally couple the launcher to the base at either of the at least two spaced apart positions.

25. A toy action play set comprising:

a base;

a first target projecting upwardly above the base;

one of an impact indicator and wall with pivotal panel members, operatively associated with the first target;

a launcher including a carrier and a hand-operated actuator coupled with the carrier;

a mating structure on the launcher;

at least two complementary mating structures at spaced apart positions on the base, each complementary mating structure being configured to releasably receive the launcher mating structure and to releasably secure the launcher to the base at one of the at least two spaced apart positions, the spaced apart positions being located to permit the carrier of the launcher to be aimed at the first target when the launcher is releasably mated to the base at either of the at least two positions.

26. The toy play set of claim 25 wherein the mating structure and each complementary mating structure allowing pivotal adjustable aiming of the launcher when mated together.

27. The toy play set of claim 25 further comprising:

the impact indicator spaced apart from the first target; and a linkage mechanically coupling the first target with the impact indicator, the linkage moving the indicator a distance related to movement of the first target when the first target is impacted in an at least generally horizontal direction, the first target being supported from at least one of the base and the linkage for at least generally horizontal movement.

28. The toy action play set of claim 25 further comprising the wall with pivotal panel members having a first pair of wall panel members generally vertically hinged for generally horizontal pivotal movement above the base to define at least part of a break apart wall on the base.

* * * * *